United States Patent [19]

Fernandez et al.

[11] 4,151,402

[45] Apr. 24, 1979

[54] SYSTEM AND APPARATUS FOR COUNTING HANGING GARMENTS

[76] Inventors: Eugenio A. Fernandez, 95 S. San Gabriel Blvd., Pasadena, Calif. 91107; Edward E. Chisholm, 79 E. Highland Ave., Sierra Madre, Calif. 91024

[21] Appl. No.: 820,533

[22] Filed: Aug. 1, 1977

Related U.S. Application Data

[63] Continuation of Ser. No. 700,484, Jun. 28, 1976, abandoned.

[51] Int. Cl.[2] ..... G06M 7/00

[52] U.S. Cl. ..... 235/92 PK; 235/92 V; 235/92 R; 235/98 C; 250/222 R

[58] Field of Search ..... 235/92 PK, 92 V, 92 MS, 235/98 C, 98 B, 98 R; 250/222 PC, 224, 222 R

[56] References Cited

U.S. PATENT DOCUMENTS

| | | | |
|---|---|---|---|
| Re. 27,869 | 1/1974 | Willits et al. | 235/92 V |
| 2,022,613 | 11/1935 | Ammon | 235/98 R |
| 2,470,926 | 5/1949 | Geiseke | 235/92 V |
| 2,819,842 | 1/1958 | Adamic et al. | 235/98 R |
| 3,835,306 | 9/1974 | Bills et al. | 235/92 V |
| 3,935,997 | 2/1976 | Loje | 235/92 V |

*Primary Examiner*—Joseph M. Thesz
*Attorney, Agent, or Firm*—Huebner & Worrel

[57] ABSTRACT

A system and apparatus employs a photo sensor moving relatively to specially configured garment hangers to register electronically the number of garment hangers and in turn the garments suspended therefrom. The light source may be fixed at a specific location and the hangers movable with respect thereto or the light source may be movable with respect to stationary hangers.

22 Claims, 15 Drawing Figures

FIG. 11
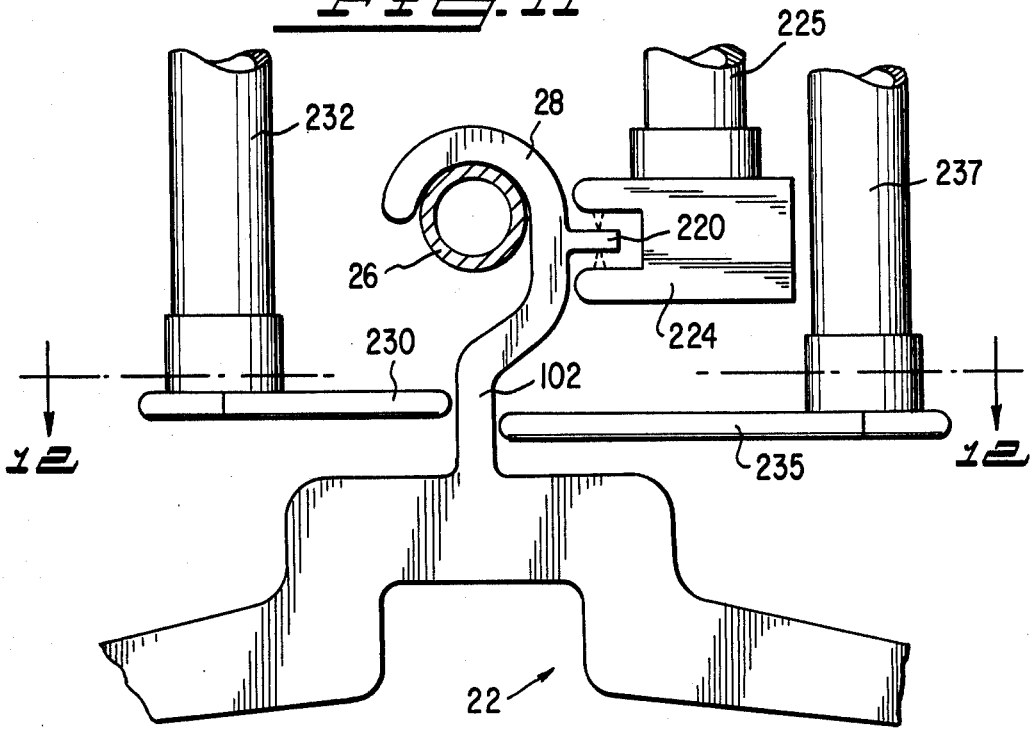
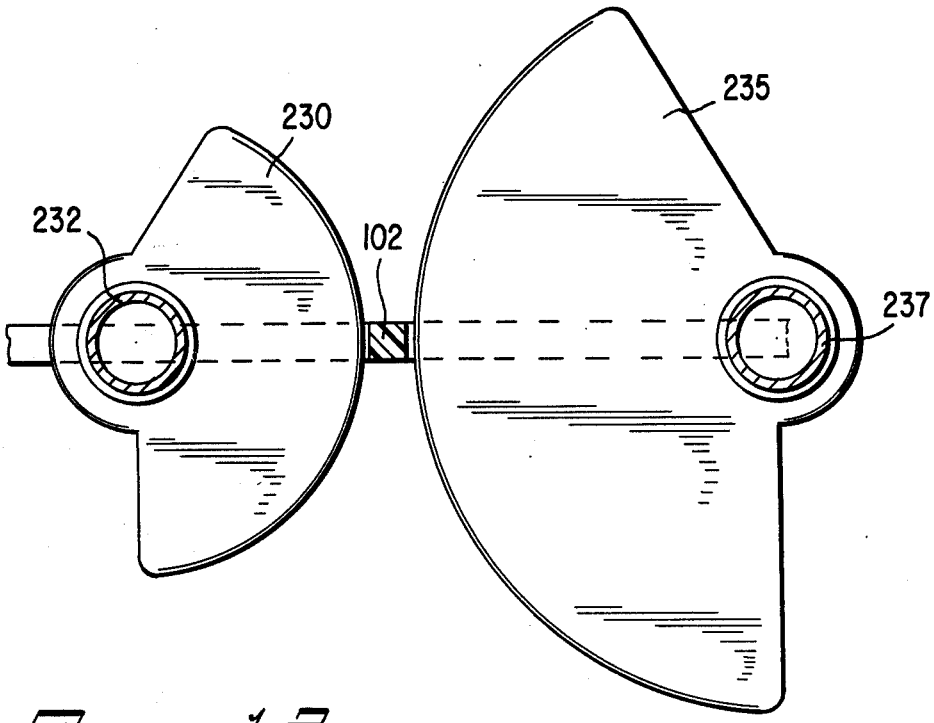
FIG. 12

SYSTEM AND APPARATUS FOR COUNTING HANGING GARMENTS

This application is a continuation-in-part of applicant's application Ser. No. 700,484 filed June 28, 1976, now abandoned.

BACKGROUND OF THE INVENTION

In the garment industry when garments, such as shirts, coats, blouses, etc., have been sewn and completed, they are normally hung on a garment hanger and stored on appropriate racks. The racks are conventionally of the fixed variety adjacent the finishing operations or they may be of the portable variety having rollers so they can be easily moved.

When garments on hangers are stored, they are usually packed tightly within the racks. In such case the mechanics of counting such stored garments for inventory control, orders or to prevent pilferage are performed manually. That is, each garment or hanger must be counted by hand which, due to human error and the packed condition of the garments, may often render the count inaccurate. In the case of the human count, a momentary distraction of the counter can cause a numerical error.

In addition, if a specific number of garments is to be transferred from one rack to another, each garment must be physically counted as well as moved. This again can result in a faulty count and also result in additional labor to make the count and move the garments and hangers.

SUMMARY OF THE INVENTION

The principal object of this invention is to provide a system and apparatus for electronically counting garment hangers and thus the garments thereon when the hangers are stacked upon a rack, whereby the possibility of human error in counting the number of garments is eliminated.

Included in the system is a scanner totalizer wherein there is a light source opposite a photo sensor, the beam of which can be interrupted by specially constructed hangers causing the photo sensor to emit an impulse to an on/off amplifier having an output to a conventional electronic counter by which the number of garments counted can be registered and visually indicated.

A further object is to provide means for aligning the hangers with respect to the scanner.

Another object of this invention is to provide a scanner totalizer which is either fixed whereby the garment hangers and garments may be passed through the scanning equipment and counted or a portable scanner totalizer which may be passed over the fixed hangers to make the appropriate count.

Another object of this invention is to provide a specially configured hanger forming a part of this invention which may be utilized with the scanner totalizer to achieve an appropriate count. The invention relating to the hanger resides in the construction for the neck and hook portion thereof.

A further object of this invention is to provide a scanner totalizer which includes a form of light source, photo sensor, amplifier, output logic and event counter with its appropriate electronics.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

FIG. 11 illustrates a modification of the structure illustrated in FIGS. 1 and 2;

FIG. 12 is a detail view, partly in section, taken on the line 12—12 of FIG. 11;

DETAILED DESCRIPTION OF THE PREFERRED EMBODIMENTS

Figure 1:
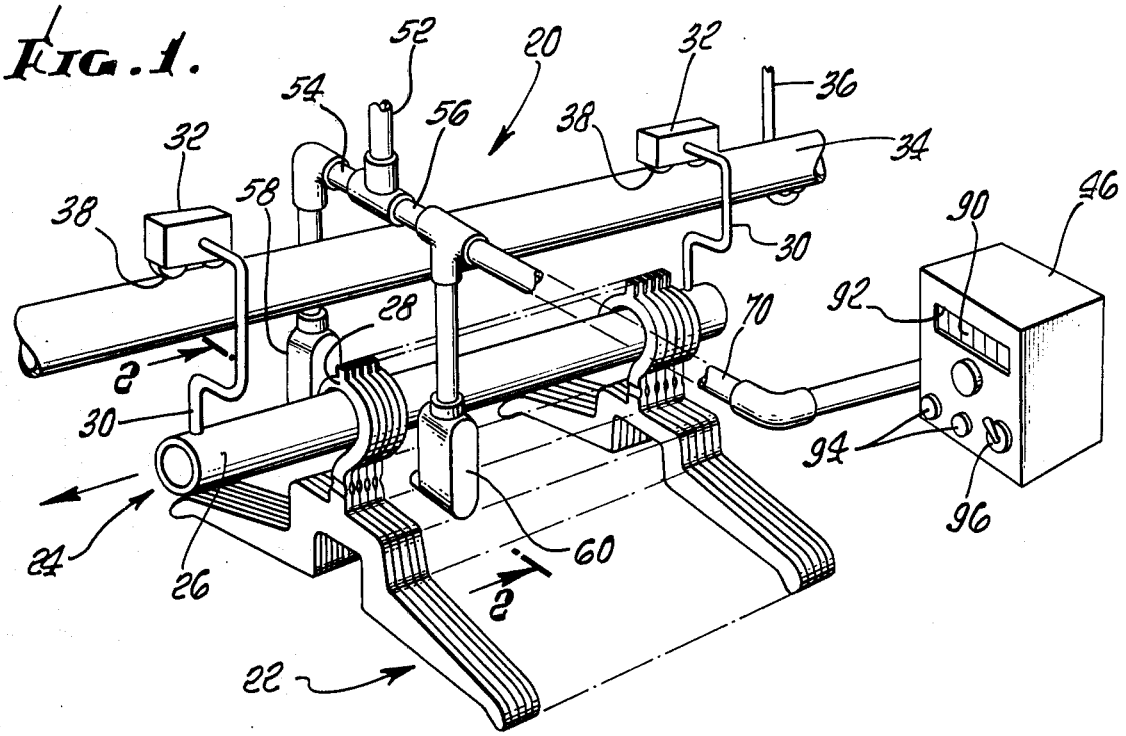
FIG. 1 is a perspective view of the system and apparatus for counting hangers wherein the scanner totalizer apparatus is fixed and the hangers move through an appropriate light beam between a light source and photo sensor.
Figure 2:
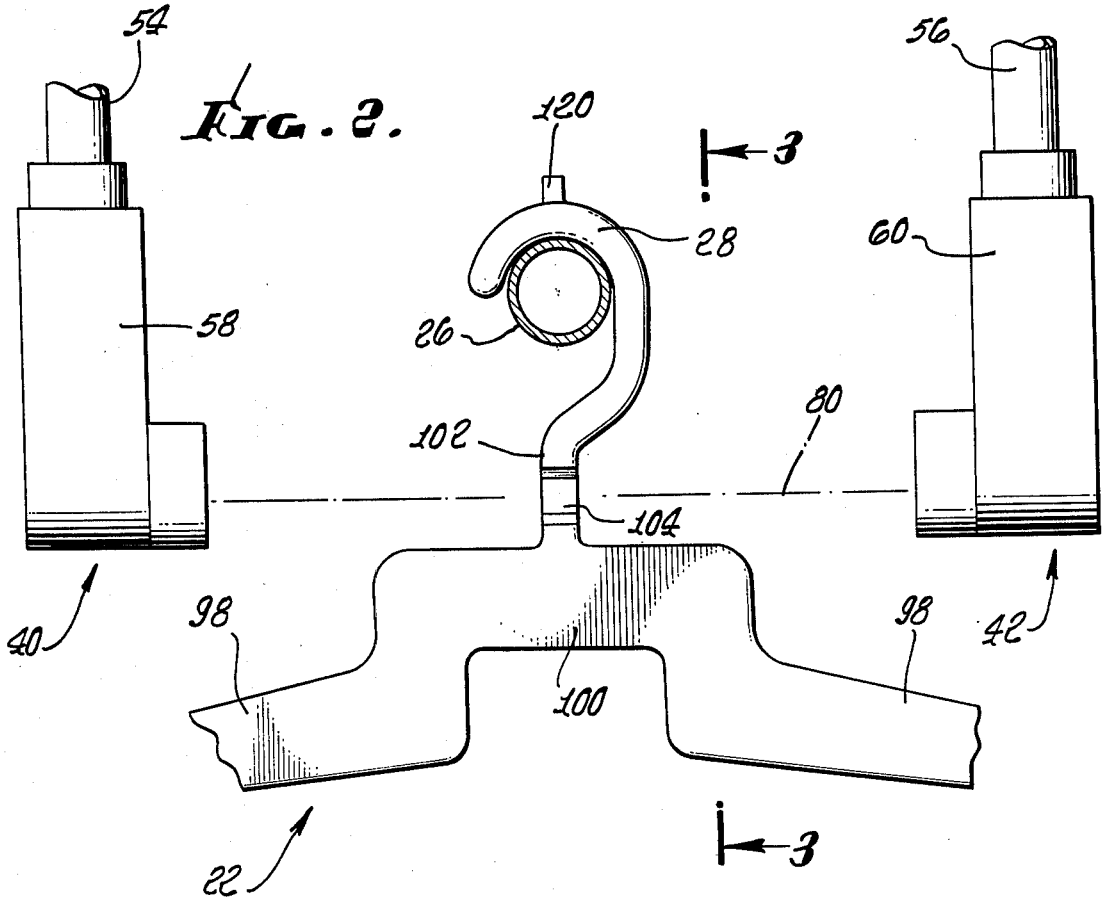
FIG. 2 is taken on line 2—2 of FIG. 1 showing the system in operation.

Referring specifically to the drawings and to FIGS. 1 and 2, there is illustrated therein a scanner totalizer generally designated 20 which is a fixed totalizer adapted to count a plurality of hangers generally designated 22 which are mounted on a movable rack generally designated 24.

In certain garment storage areas, once a garment has been sewn and is properly hung on a hanger, a number of garments including their hangers are hung on a rack which is suspended on a hanger pipe such as the pipe 26.

In turn the hanger pipe 26 is secured to a pair of support brackets 30 which extend upwardly to a roller carriage or trolley 32 which in turn is mounted upon a travel pipe such as the pipe 34 which may be suspended from the ceiling or ceiling supports by means of struts 36. The roller carriage 32 includes a plurality of rollers 38.

In operation, the hanger pipe 26 may be pushed along the travel pipe 34 carrying the hangers 22 and garments suspended therefrom packed tightly between the support brackets 30 at each end of the hanger pipe 26 for movement about the warehouse or sewing room.

According to the present invention there is located along the line of travel of the travel pipe 34 a scanner totalizer generally designated 20. The scanner totalizer 20 preferably includes a light source generally designated 40 (FIG. 2), and a receiver or photo sensor generally designated 42 which communicates by appropriate wiring with a housing 46 containing an amplifier generally designated 48 (FIG. 9) and event counter generally designated 50.

Figure 9:
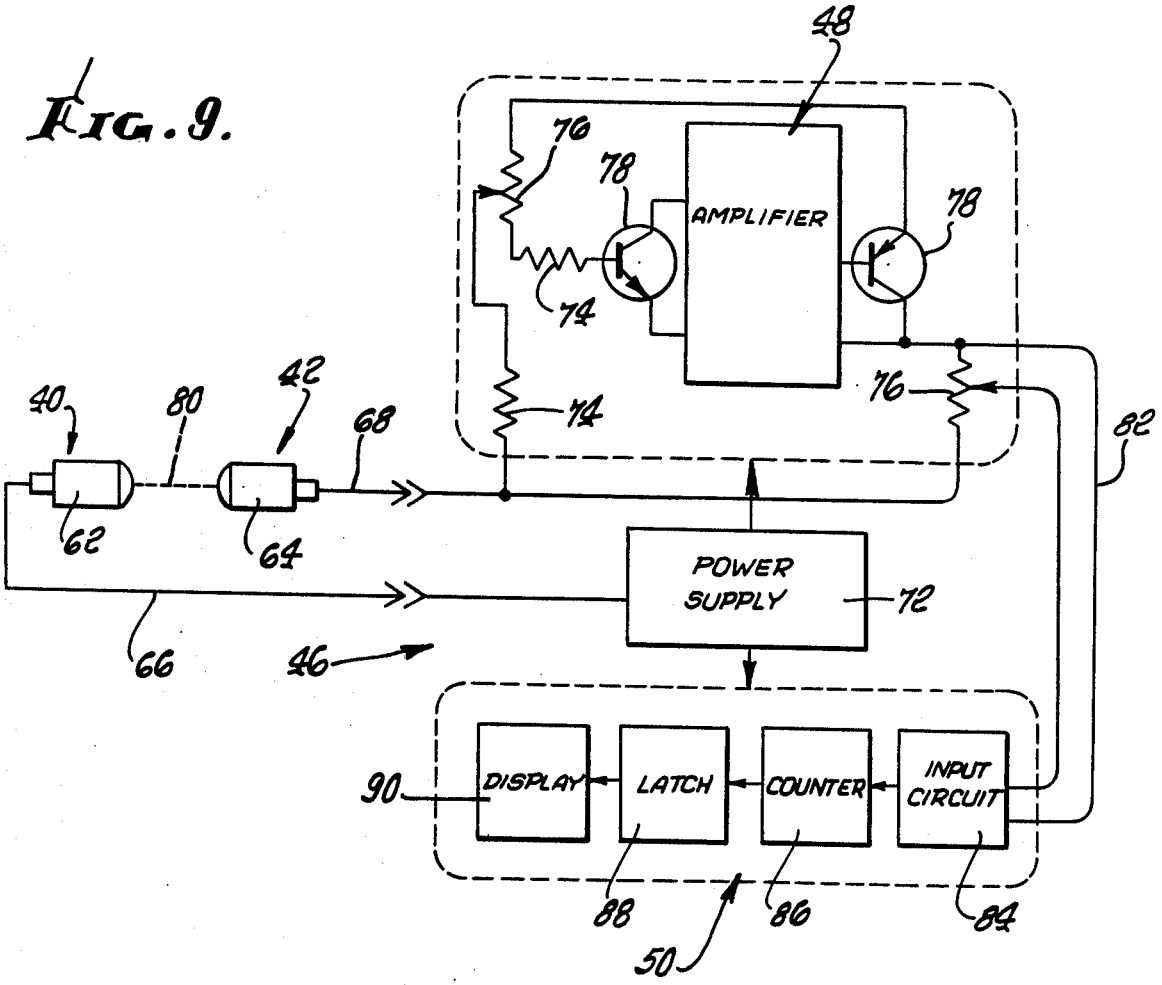
FIG. 9 is a schematic diagram of the scanner totalizer.

In the construction shown in FIGS. 1 and 2, a frame is preferably suspended from the ceiling or ceiling structure by means of a support member 52. From the support member 52 conduits 54 and 56 extend downwardly from the support member 52 around and below the travel pipe 34 and terminate in a light source housing 58 and photo sensor housing 60. Mounted within the light source housing 58 is a light source generally designated 40 which may be a miniature incandescent bulb or light emitting diode 62 (see also FIG. 9). Coaxially aligned and spaced therefrom within the photo sensor housing 60 is an appropriate photo sensor generally designated 42 (FIG. 2) such as a fast response photo transistor 64 (FIG. 9).

The diode 62 is connected by wiring 66 extending through the housing 58 (FIG. 1) and conduit 54 to power supply 72. Wiring 68 extends from the photo sensor 64 through the housing 60 and conduits 56 and 70 to the housing 46. The power supply 72 (FIG. 9) can be in the form of a rechargeable battery or directly through an appropriate electrical wire to an A/C source of power. Also by leads power from the power supply 72 passes to the amplifier section 48 and event counter 50.

The wiring 68 when reaching the housing 46 passes therethrough into the amplifier section 48 of the totalizer and through appropriate resistors 74, potentiometers 76 and transistors 78 from which the impulse created by a break in the light beam 80 passing between the light source 40 and photo sensor 42, moves through an appropriate lead wire 82 to the event counter portion generally designated 50. At this stage any type of conventional event counter 50 can be utilized wherein there is an input circuit 84 from which the impulse will pass to an electric counter 86 thence to electronic latching means 88 for holding the numbers of the count and thence to a digital visual display means 90 which may be visually read through an appropriate opening 92 in the housing 46.

There is also preferably included in the housing 46 and connected with the event counter 50 various control knobs 94 for resetting the counter and further there is an on/off switch 96 to control the flow of power through the power source 72.

In operation, the beam 80 passing between the light source 40 and the photo sensor 42 on a coaxial plane as shown in FIG. 2 is continually on and when an object passes through the beam 80, such as the hanger generally designated 22, shown in FIG. 2, the light source is broken. This "break" is transmitted to the photo sensor 42 which closes and the impulse is passed to the amplifier 48 and by conventional output logic through the event counter 50 for preferred visual registration by the digital display means 90.

While the visual display means 90 is the preferred method of recording in this invention, it should be appreciated that other forms of display may be effected through appropriate electronics other than the digital display means 90.

Figure 3:
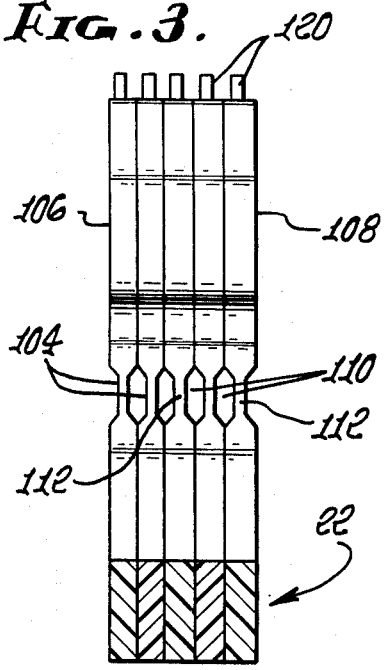
FIG. 3 is taken on line 3—3 of FIG. 2 and shows the details of the plurality of the unique hangers forming a part of this invention.

The hangers 22 (FIG. 2) are formed of plastic having the conventional shoulder portions 98 extending outwardly from a bridge 100. Extending upwardly from the bridge 100 is a neck portion 102 terminating in an arcuate hook portion 28. The neck portion 102 is formed with a pair of notches or recesses 104 extending inwardly from sides 106 and 108, respectively, of the hangers 22 as best seen in FIG. 3. These recesses 104 are axially aligned, whereby when the respective hangers 22 are placed in side by side contact wherein the side 108 of one hanger abuts the side 106 of an adjacent hanger, there is actually formed between each of the hangers openings 110.

While the preferred embodiment includes a pair of recesses 104 on each side of the neck portion 102, it should be realized that a single recess 104 extending inwardly from either side 106 or 108 on the respective hangers 22 will serve the same purpose, creating a hanger opening 110 between the respective abutting hangers 22.

When it is desired to utilize the scanner totalizer 20, the light source 40 and photo sensor 42 within the respective housings 58 and 60 may be adjusted upwardly or downwardly when the hanger 22 is hung on the hanger pipe 26 whereby the beam 80 will pass through the openings 110 as best seen in FIG. 2. When the light beam 80 passes uninterrupted through the openings 110 created by the respective notches or recesses 104 of adjacent hangers 22, there is no registry in the amplifier or event counter 50. However, as the hangers on the hanger pipe 26 are moved through the beam 80, the beam will be broken by the reduced neck portion 112 of the hanger 22 which in turn will, through the electronics previously described and illustrated in FIG. 9, register in numerical sequence. As the hanger pipe 26 is further moved through the beam 80, each time the beam 80 is interrupted by the reduced neck portion 112 that hanger will be counted and in turn the garment suspended therefrom.

From tests conducted of the scanner totalizer 20 through the appropriate electronics of the scanner totalizer 20, the response of the light sensor through the appropriate logic as aforedescribed is sensitive so that millisecond response is achievable and an accurate count is achieved no matter how rapidly the hangers 22 are passed through beam 80.

Figure 6:
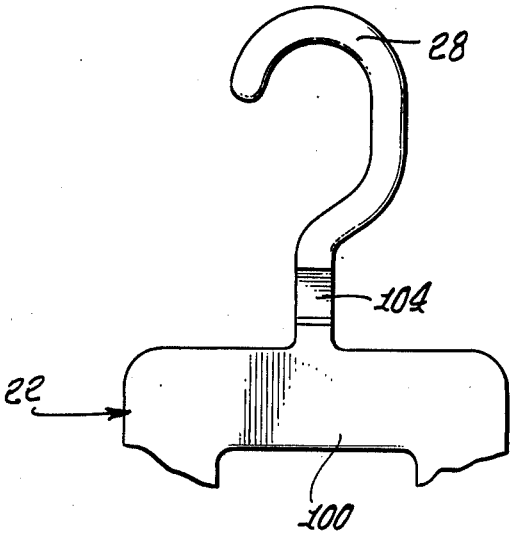
FIG. 6 is a further modified form of the unique hanger of FIGS. 1 and 2.

As seen in FIGS. 1 through 3 and 7 and 8, each hanger 22 incorporates at the top of the curved hook portion 28 projecting tabs 120 with a thickness less than the thickness of said hook portion 28. These tabs are for utilization with a modified form of the scanner totalizer 20 to be subsequently described. The tabs 120 are not utilized by the fixed scanner totalizer 20 shown in FIG. 1, and when that totalizer is used, a hanger 22 such as illustrated in FIG. 6 without the projecting tabs 120 may be utilized.

Figure 4:
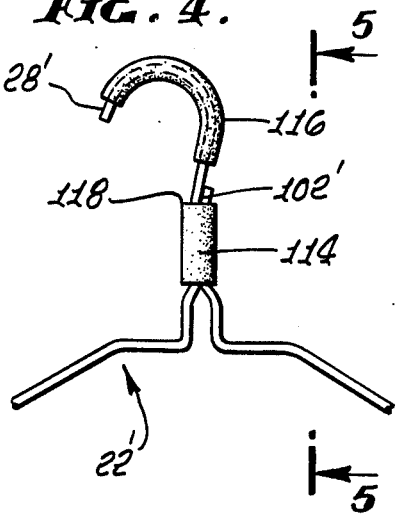
FIG. 4 is a modified form of the unique hanger illustrated in FIGS. 2 and 3.
Figure 5:
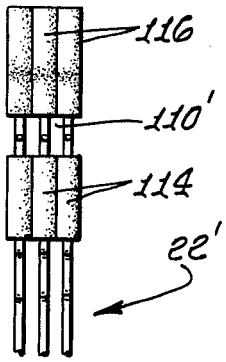
FIG. 5 is a view taken on line 5—5 of FIG. 4 showing a plurality of the modified hangers of FIG. 4.

In certain cases where the hangers 22 are not of the conventional plastic design such as shown in FIGS. 1 through 3, conventional wire hangers generally designated 22' in FIGS. 4 and 5 may be utilized with an appropriate modification whereby appropriate counting can be achieved. With regard to the modification of the hanger 22' there is preferably placed over the neck portion 102' a plastic or rubber sleeve 114 which is moved to the bottom of the neck 102 as best seen in FIG. 4 and an additional sleeve 116 of plastic or rubber placed over the hook portion 28' wherein it is spaced from the end 118 of the sleeve 114. This then creates an opening 110' between a pair of juxtaposed garment hangers 22' for appropriate registry between the light source 40 and photo sensor 42.

Figure 8:
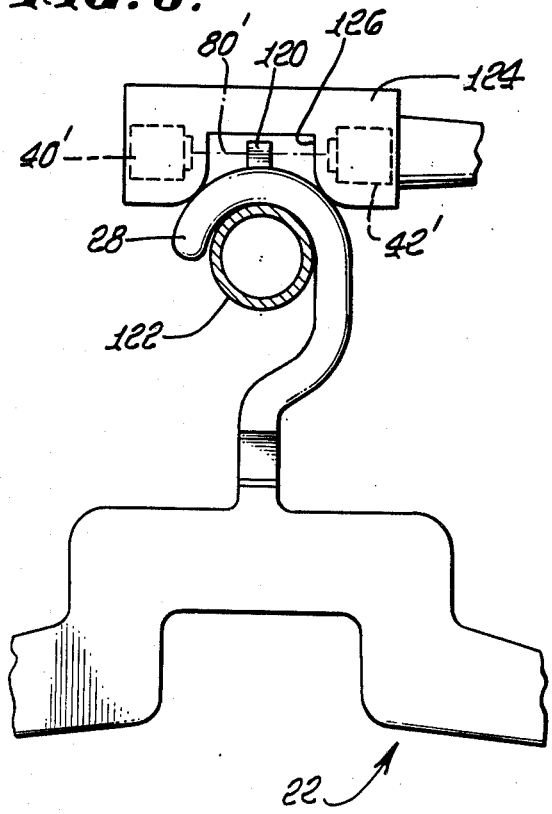
FIG. 8 is a detailed view of the scanning equipment for the portable modified unit of FIG. 7.
Figure 7:
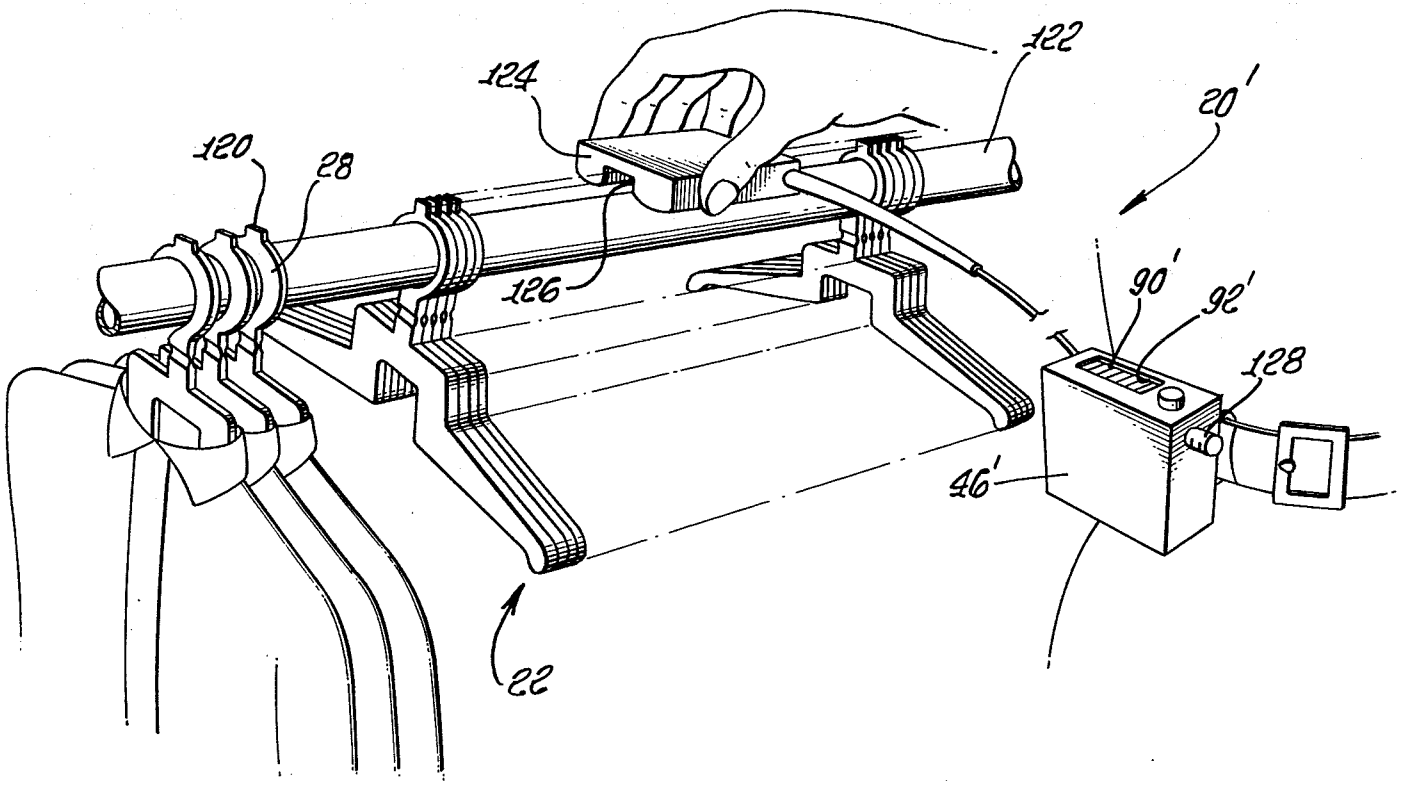
FIG. 7 is a perspective view of a modified form of the counting system wherein the light source and photo sensor are portable and adapted to be moved by hand when the hangers are in a fixed position.

In FIGS. 7 and 8 there is illustrated a portable scanner totalizer generally designated 20'. This particular type of scanner is particularly useful when the hangers 22 are mounted on a fixed rack including a supporting pipe 122. In this case the light source 40' (FIG. 8) and the photo sensor 42' are mounted within a hand held housing 124 having a channel 126 extending through said housing. In this case the light source 40' passes the beam 80' from one side of the channel to the photo sensor 42'.

In order to utilize the housing 124 it is hand held as seen in FIG. 7 and moved over the top of the hook portion 28 of the hangers 22 so that the projecting tabs 120 intercept the beam 80' to provide the appropriate counting through a portable housing 46' mounted upon the belt of a person making the count. As can be seen in FIG. 7, through the opening 92' the digital display means 90' can be observed by the wearer. In addition, the portable housing 46' includes control means 128 to control the power to the electronics and to reset the digital display means 90'.

Again because of the appropriate electronics previously described, the hand held housing 124 may be moved as rapidly as possible along the top of the hook portion 28 and the projecting tabs 120 will create the necessary registry and breaking of the beam 80' for accurate counting.

Figure 10:
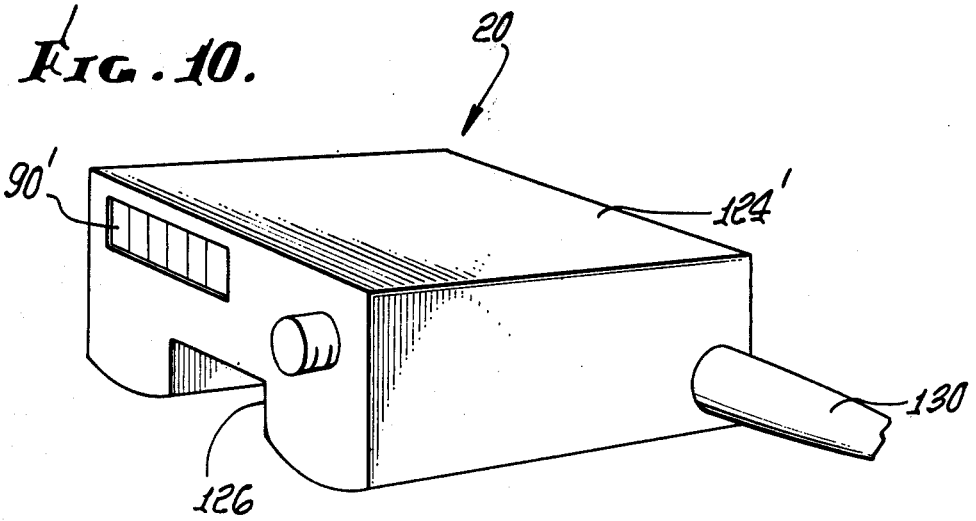
FIG. 10 is a perspective view of a form of the modified scanner equipment illustrated in FIG. 7.

In FIG. 10 there is illustrated an additional modification 124' of the hand held portable unit shown in FIG. 7. In this particular case the housing 124' may be expanded in size whereby the appropriate electronics as illustrated in FIG. 9 can be enclosed within the housing and a readout may be obtained through the digital display means 90'. In this particular case it may be appropriate to have a cable 130 leading to a power supply such as can be carried by the person who is moving the housing 124' to count the hangers 22 on the fixed rack 122. However, with appropriate planning and design, the power source can be built into the housing 124' and the unit will be completely self-contained.

If it is known that the portable scanner totalizer 20' is to be used, the hangers 22 can be manufactured without the necessity of the notches 104 merely retaining the projecting tabs 120 such as shown in FIG. 8.

In the modification shown in FIG. 11, tabs 220 functionally corresponding to the tabs 120 of the hangers shown in FIGS. 1 to 3, 7 and 8 are disposed on the sides of the hook portions 28 of the hangers 22 instead of at the top portions thereof, and a scanning unit 224 corresponding generally to the scanning unit 124 of FIGS. 7 and 8 and embodying both a light source and a photo sensor as does that scanning unit, is suspended by conduit 225 in the same manner as are the separate light source and photosensor units 40, 42 of FIGS. 1 and 2; conduit 225 being connected to a unit corresponding to the unit 46 of FIG. 1 by a conduit corresponding to the conduit 70 of that figure.

Also suspended from a fixed portion of the frame corresponding to the conduit 70 of FIG. 1 are means for engaging the neck portions 102 of hangers 22 to effect alignment of the tabs 220 in a common plane for passage through the light beam of the photo sensor unit 224. This means comprises a first arcuate cam 230 secured to the lower end of a conduit 232 suspended from the frame 70 and a second arcuate cam 235 secured to the lower end of a conduit 237 also suspended from the frame 70. These cams are so disposed with respect to each other that they most closely approach at a position exactly opposite the position of the scanning unit 224 so that, as shown in FIG. 12, the neck portions 102 of the hangers 22 are brought into alignment with each other at that position, thus aligning the tabs 220 in a common plane for passage through the slot of the scanning unit 224.

Figure 13:
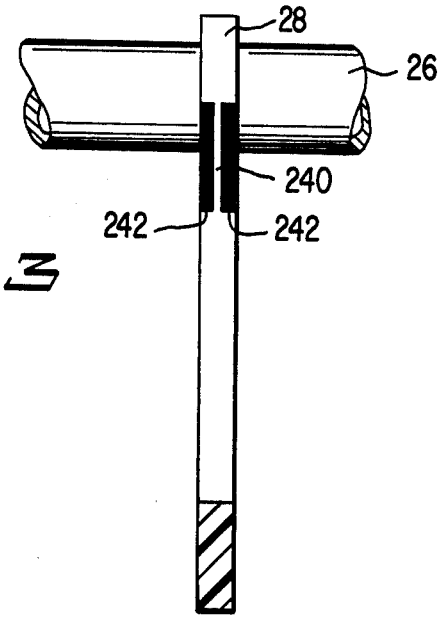
FIG. 13 is a detail view in side elevation of a modified form of hanger.
Figure 14:
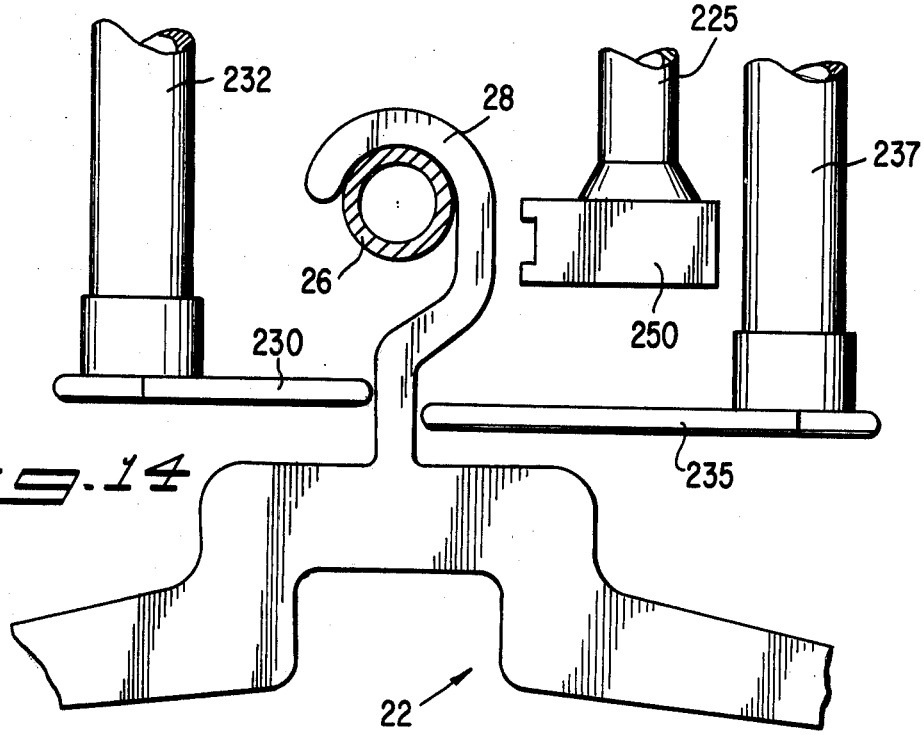
FIG. 14 illustrates an additional modification of the structure illustrated in FIGS. 1 and 2, utilizing the hanger structure of FIG. 13.
Figure 15:
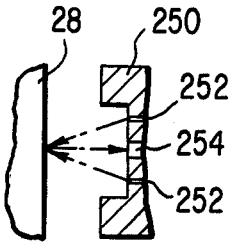
FIG. 15 is a detail view of the light source and photosensor of the scanner of FIG. 14.

In the modification illustrated in FIGS. 13, 14 and 15 the side of the hook portion 28 of each of the hangers 22 is provided with a light reflective portion 240 flanked on each side by a blackened non-reflective portion 242 and a scanning unit 250, suspended in the same manner as is the scanning unit 224 of FIG. 11, embodies both a light source and a photo sensor so arranged, as shown in FIG. 15, as to emit light through slots 252 toward the hook portions 28 of hangers 22 which light, when reflected back from the reflective portion 240 of such a hanger, will impinge upon the photo sensor of the scanning unit through an aperture 254 therein. Preferably this modification also employs the aligning means 230, 235 which has been illustrated and described in connection with FIGS. 11 and 12.

The invention and its attendant advantages will be understood from the foregoing description and it will be apparent that various changes may be made in the form, construction, and arrangements of the parts of the invention without departing from the spirit and scope thereof or sacrificing its material advantages, the arrangements hereinbefore described being merely by way of example. I do not wish to be restricted to the specific form shown or uses mentioned except as defined in the accompanying claims, wherein various portions have been separated for clarity of reading and not for emphasis.

We claim:

1. A system for electronically counting garments suspended from unique hangers by counting said hangers where said hangers are hung on a rack comprising:

a scanner totalizer including a light source adapted to emit a light beam, a receiver means receiving said beam, an on/off electronic amplifier means connected to said receiver, an electronic event counter connected to said amplifier means to register a numerical count when said light beam is intercepted and said amplifier means is activated and a power source adapted to power said scanner totalizer;

said light source and said receiver are coaxially aligned and spaced one from the other;

a portion of each of said unique hangers on said rack positioned to pass between said light source and said receiver;

said portion of each of said hangers being of such a construction that when they are juxtaposed one with the other said light beam may pass uninterrupted between said juxtaposed hangers with no numerical registry in said electronic event counter yet each hanger having a part of said portion capable of interrupting said light beam and in turn activating said amplifier and registering said interruption numerically in said electronic event counter.

2. A system as defined in claim 1 wherein said light source is an incandescent bulb.

3. A system as defined in claim 1 wherein said light source is a light emitting diode.

4. A system as defined in claim 1 wherein said receiver is a photo sensor.

5. A system as defined in claim 4 wherein said photo sensor is a fast response phototransistor.

6. A system as defined in claim 1 wherein said electronic event counter includes a digital numerical visual readout.

7. A system as defined in claim 1 wherein said light source and said receiver are fixedly mounted and said rack is adapted to move longitudinally and said portion of each hanger passes between said light source and receiver to register a numerical count.

8. A system as defined in claim 1 wherein said light source and said receiver are mounted in a single housing and said housing is portable and adapted to be moved over said portion of each hanger which is between said light source and receiver to register a numerical count.

9. A system as defined in claim 8 wherein said housing includes a channel having a longitudinal axis and said light beam extends normal to said axis.

10. A system as defined in claim 9 wherein said portion of each of said unique hangers includes a hook and a projection extending upwardly therefrom, said projection having a thickness less than the thickness of said hook and said projection is adapted to enter said channel.

11. A system as defined in claim 1 wherein said scanner totalizer is mounted in a single housing and is portable and adapted to be moved over said portion of each hanger which is between said light source and receiver to register a numerical count.

12. A system as defined in claim 1 wherein:

said portion of each of said unique hangers includes a generally vertically extending neck having generally parallel sides and spaced apart ends normal to said sides;

said neck terminating upwardly in a hook to be received on a rack;

a pair of aligned notches extending inwardly from each side of said neck between said ends whereby when at least a pair of hanger necks and hooks are juxtaposed an opening will be created by said notches between said necks of said hangers to allow said light beam to pass uninterrupted yet said neck between the respective notches on each side thereof capable of interrupting said light beam for appropriate numerical registry.

13. A system as defined in claim 1 wherein a plurality of said hangers in juxtaposed position one to another may be counted rapidly.

14. In a garment hanger having a shoulder portion, neck portion and hook portion for use with apparatus for electronically counting said hanger and a garment suspended from said hanger where said hanger is hung on a rack, and said apparatus for electronically counting said hanger includes a scanner totalizer having a light source adapted to emit a light beam, a receiver means receiving said beam, an on/off electronic amplifier means connected to said receiver, an electronic event counter connected to said amplifier means to register a numerical count when said light beam is intercepted and said amplifier means is activated and a power source adapted to power said scanner totalizer, and said light source and said receiver are coaxially aligned and spaced one from the other, the improvement comprising:

a portion of said hanger above said shoulder portion of such a construction that when said hanger neck portion and said hook portion are juxtaposed with an adjacent garment hanger of the same construction said light beam may pass uninterrupted between said juxtaposed garment hangers with no numerical registry in said electronic event counter yet said garment hanger having a part capable of interrupting said light beam and in turn activating said amplifier and registering said interruption numerically in said electronic event counter.

15. In a garment hanger as defined in claim 14 wherein said improvement includes:

said neck portion having generally parallel sides and spaced apart ends generally normal to said sides, and at least one recess extending inwardly from one side of said neck portion between said ends whereby when at least a pair of garment hanger neck portions of the same construction are in side by side contact an opening will be created to allow said light beam to pass therethrough and said neck portion between said recess and said opposite parallel side will interrupt said light beam.

16. In a garment hanger as defined in claim 14 wherein said improvement includes:

said neck portion having generally parallel sides and spaced apart ends generally normal to said sides, and a pair of aligned recesses extending inwardly from each side of said neck portion between said ends forming a reduced thickness neck portion intermediate said recesses, whereby when at least a pair of garment hanger neck portions of the same construction are in side by side contact an opening is created therebetwen to allow said light beam to pass therebetween and said reduced neck portion will interrupt said light beam.

17. In a garment hanger as defined in claim 14 wherein said improvement includes said hook portion having generally parallel sides; and a tab projecting upwardly from said hook portion;

said tab having a thickness less than the distance between said generally parallel sides, whereby when at least a pair of garment hanger hook portions of the same construction are in side by side contact a space is created between said tabs, and said tab adapted to be aligned between said light source and said receiver to interrupt said light beam yet having a sufficient space between an adjacent tab to prevent the interruption of said light beam during movement.

18. In a garment hanger as defined in claim 14 wherein said hanger is a conventional wire hanger having a shoulder portion connected to a neck portion and in turn connected to a hook portion the improvement comprising:

a first tubular spacer means having bottom and top ends and an exterior diameter greater than the thickness of said neck, said first tubular spacer means being mounted around said neck portion whereby said bottom end generally abuts said shoulder portion and said top end terminates part way up said neck portion;

a second tubular spacer means of an exterior diameter corresponding with the exterior diameter of said first tubular spacer and having bottom and top ends, said second tubular spacer means being mounted around said hook portion and a portion of said neck portion with said bottom end spaced from said top end of said first tubular member whereby a recess is provided between said neck portion and said ends to allow the passage of said light beam without interruption.

19. A method of electronically counting garments which comprises the steps of:

utilizing a scanner totalizer including a light source adapted to emit a light beam, a receiver means receiving said beam, an on/off electronic amplifier means connected to said receiver, an electronic event counter connected to said amplifier means to register a numerical count when said light beam is intercepted and said amplifier means is activated and a power source adapted to power said scanner totalizer;

aligning said light source and receiver coaxially and spaced one from the other;

selecting a plurality of garment hangers each having a garment thereon, and each hanger having a shoulder, neck and hook portion;

placing said hangers upon a rack in abutting side by side relationship wherein said neck and hook portions of adjacent hangers may contact each other;

providing a construction in said neck and hook portions of each of said hangers adapted to pass through said light beam wherein said construction allows said light beam to pass between adjacent hangers uninterrupted with no numerical registry in said electronic event counter yet such construction including a portion of each hanger capable of interrupting said light beam;

creating an electric impulse in said receiver when said light beam is interrupted;

activating said on/off amplifier and passing a logic impulse to said event counter; and recording a numerical count within said event counter of each of said hangers interrupting said light beam.

20. A method of electronically counting garments as defined in claim 19 including:

aligning said light source and said receiver in a fixed position; and passing said rack of hangers between said beam.

21. A method of electronically counting garments as defined in claim 19 including:

providing a portable housing to encompass said light source and said receiver; and passing said housing over said hanger construction when said hangers are on a rack in a fixed position.

22. In a system for automatically monitoring garments in a group suspended on hangers from a common rail, the combination of a plurality of hangers each adapted to support a garment and each including a hook portion for suspending each hanger from said rail, symmetrically extending shoulder portions suspended from said hook portion, a signal activating portion between said hook portion and said shoulder portions occupying a position in a common plane with such portions of other hangers so suspended when said hanger is suspended from such a rail; an electrical signal transmitter including a portion responsive to relative movement of each of said signal activating portions with respect thereto to emit a signal pulse, and means engageable with the signal activating portions of said hangers for aligning said signal activating portions in a common plane as said signal activating portions are brought adjacent said transmitter.

* * * * *